US006584799B2

(12) United States Patent
Jung et al.

(10) Patent No.: US 6,584,799 B2
(45) Date of Patent: Jul. 1, 2003

(54) COOLING AIR BLOWING APPARATUS OF REFRIGERATOR

(75) Inventors: Young Gyu Jung, Incheon (KR); Chang Joon Kim, Seoul (KR); Seung Jo Baek, Gwangmyeong (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/058,354

(22) Filed: Jan. 30, 2002

(65) Prior Publication Data

US 2003/0024264 A1 Feb. 6, 2003

(30) Foreign Application Priority Data

Aug. 3, 2001 (KR) ..... 2001/47023

(51) Int. Cl.[7] ..... F25D 17/08
(52) U.S. Cl. ..... 62/419; 62/446; 416/228
(58) Field of Search ..... 416/203, 228, 416/235; 62/419, 446

(56) References Cited

U.S. PATENT DOCUMENTS 3,794,443 A * 2/1974 McCarty ..... 416/175
5,226,783 A * 7/1993 Mita ..... 416/223 R
5,736,968 A * 4/1998 Tsakiris ..... 345/2.2
5,971,709 A * 10/1999 Hauser ..... 416/175
6,435,828 B1 * 8/2002 Bostwick ..... 416/175

FOREIGN PATENT DOCUMENTS

EP 0881395 A2 12/1998
GB 2306212 A 4/1997

* cited by examiner

*Primary Examiner*—William E. Tapolcai
(74) *Attorney, Agent, or Firm*—Fleshner & Kim, LLP

(57) ABSTRACT

A cooling air blowing apparatus of a refrigerator includes: a driving motor fixed at a motor mount formed at a rear side of a freezing chamber; a blowing fan mounted on a rotational shaft of the driving motor and configured to blow cooling air in both an axial and a radial direction as the driving motor is driven; and a shroud positioned in a circumferential direction of the blowing fan. The blowing fan includes turbo blades for blowing cooling air in a radial direction in addition to the axial flow blade for blowing cooling air in an axial direction. The cooling air blown in the axial direction is sent to a freezing chamber, while the cooling air blown in the radial direction is sent to the cooling chamber. Thus, the blowing fan with the turbo blades ensures that in a refrigerator having a complicated and long cooling air passage structure, cooling air can be circulated smoothly and quickly.

14 Claims, 7 Drawing Sheets

COOLING AIR BLOWING APPARATUS OF REFRIGERATOR

BACKGROUND OF THE INVENTION

1. Field of the Invention

The present invention relates to a cooling air blowing apparatus of a refrigerator, and more particularly, to a cooling air blowing apparatus of a refrigerator that is capable of improving an efficiency of a refrigerator by increasing air flow and reducing a noise.

2. Description of the Background Art

In general, a refrigerator includes a freezing chamber for keeping frozen items and a cooling chamber for keeping refrigerated food, and a freezing cycle is also provided therein to supply cooling air to the freezing chamber and the cooling chamber.

The refrigerator is increasingly having a large capacity and in order to keep foodstuffs in a fresh state for a long period, it is requisite to maintain an internal temperature to be uniform. For this purpose, a method is adopted that cooling air is discharged from several grill holes of the cooling chamber, for which cooling air passage tends to be lengthened and complicated to guide cooling air to each direction of the cooling chamber.

FIG. 1 is a side sectional view of a refrigerator in accordance with a conventional art, and FIG. 2 is a partial sectional view showing that an axial flow fan is mounted in the refrigerator in accordance with the conventional art.

The conventional refrigerator includes: a main body 104 having a certain space for storing foodstuffs and a door mounted to be opened and closed at a front side; a freezing chamber 106 formed at an upper side of the main body 104 and storing a frozen food; a cooling chamber 110 separated from the freezing chamber by a barrier 108 and formed at a lower portion of the main body 104 and storing a refrigerated food; a heat exchanger 112 mounted at a rear side of the freezing chamber 106 and providing cooling air through heat exchange with a refrigerant, and a cooling air blowing unit supplying cooling air generated while passing the heat exchanger 112 to the freezing chamber 106 and the cooling chamber 110.

The cooling air supply unit includes an axial flow fan 114 mounted at a rear side of the freezing chamber 106 and blowing cooling air in an axial direction of a direction that cooling air is introduced; a grill fan 118 having discharge holes 116 discharging cooling air blown by the axial flow fan 114 to the freezing chamber 106; a supply passage connected to a lower side of the grill fan 118 and supplying cooling air blown by the axial flow fan 114 to the cooling chamber 110; and a cooling air duct 132 connected to the supply passage 120 and formed at least one of at a rear side and at a side face of the cooling chamber 110 and having a plurality of cooling air discharge holes 122 discharging cooling air to the cooling chamber 110.

The axial flow fan 114 is fixed at a rotational shaft 126 of a driving motor 124, the driving motor 124 is fixed at a motor mount 128 formed inside the grill fan 118, and a shroud 130 is formed at a circumferential direction of the front side of the motor mount 128.

The supply passage 120 is formed between the shroud and the grill fan so as to be connected to a lower side of a branch passage 150 for distributing cooling air blown from the axial flow fan into the cooling chamber and the freezing chamber, and serves as a passage for supplying cooling air blown from the axial flow fan 114 to the cooling air duct 132.

At the barrier 108, a suction passage 134 is prepared through which cooling air which has completed a freezing operation of the freezing chamber 106 is sucked to the heat exchanger 112, and a suction barrier 136 is also prepared through which cooling air which has completed a cooling operation of the cooling chamber 110 is sucked to the heat exchanger 112.

FIG. 3 is a front view of the axial flow fan in accordance with the conventional art.

The conventional axial flow fan 114 includes a hub 152 connected to the rotational shaft 126 of the driving motor 124 and receiving a driving force of the driving motor 124, and a plurality of blades 154 installed at regular intervals at an outer circumferential face of the hub 152 and generating a blowing force.

The blade 154 is extended in a curved form having a certain curvature from the outer circumferential face of the hub 152. Typically, four blades are formed.

Typically, the axial flow fan 114 blows cooling air in a suction direction along the axial direction.

The operation of the refrigerator constructed as described above will now be explained.

When the axial flow fan 114 is rotated according to driving of the driving motor 124, cooling air which has passed the heat exchanger 112 is blown to the branch passage, discharged from the branch passage to the freezing chamber 106 through the discharge hole 116 of the grill fan 118 and also supplied to the supply passage 120.

The cooling air discharged to the freezing chamber 106 circulates in the freezing chamber 106 to perform a freezing operation and sucked to the heat exchanger 112 through the suction passage 134.

Cooling air introduced into the supply passage is supplied to the cooling air duct 132, discharged to the cooing chamber 110 through the plurality of discharge holes 122 formed at the cooling air duct 132, circulates in the cooling chamber 110 to perform a cooling operation, and sucked into the heat exchanger 112 through the suction passage 136.

However, the cooling air blowing apparatus of a refrigerator in accordance with the conventional art has the following problems.

That is, cooling air is blown in a suction direction along the axis direction from the axial flow fan. Thus, cooling air supplied to the freezing chamber is smoothly blown as the discharge hole of the grill fan is connected in the axial direction. But as for the cooling air supplied to the supply passage connected in the orthogonal direction in which cooling air flows through the axial flow fan, a flow resistance occurs, causing that the amount of cooling air supplied to the storage chamber is relatively small and thus a cooling operation is not smoothly performed.

Especially, as refrigerators are on the trend of becoming large, the supply passage for supplying cooling air is lengthened and complicated, so that a great amount of flow resistance occurs to flowing of the cooling air.

In order to circulate cooling air smoothly and quickly under the condition of the high flow resistance, the axial flow fan should have a large diameter or an RPM should be increased.

However, in case of enlarging the diameter of the axial flow fan, the size of the refrigerator is increased and a noise is accordingly generated. Meanwhile, in case of increasing the RPM, since the noise is increased, the quality of the refrigerator is degraded.

Especially, when the refrigerator is operated for a long period, when the heat exchanger is frosted, a noise becomes more loud while the air volume becomes small, resulting in that the freshness of the foodstuffs kept in the cooling chamber is degraded.

SUMMARY OF THE INVENTION

Therefore, an object of the present invention is to provide a cooling air blowing apparatus of a refrigerator that is capable of circulating cooling air smoothly and quickly even in a cooling air passage structure which is long and complicated by blowing cooling air in a suction direction along the axis direction and blowing cooling air in a radial direction of the direction in which cooling air is sucked.

Another object of the present invention is to provide a cooling air blowing apparatus of a refrigerator that is capable of reducing a noise by increasing an amount of cooling air supplied to a cooling chamber and a freezing chamber even without increasing a diameter of an axial flow fan or an RPM, and capable of increasing a blowing efficiency and improving a quality of a refrigerator.

To achieve these and other advantages and in accordance with the purpose of the present invention, as embodied and broadly described herein, there is provided a cooling air blowing apparatus of a refrigerator including: a driving motor fixed at a motor mount formed at a rear side of a freezing chamber; a blowing fan mounted at a rotational shaft of the driving motor and blowing cooling air in a suction direction along the axis direction and blowing cooling air in a suction direction along a radial direction, while being rotated as the driving motor is driven; and a shroud positioned in a circumferential direction of the blowing fan.

In the cooling air blowing apparatus of a refrigerator of the present invention, the blowing fan includes a hub fixed at the rotational shaft of the driving motor, axial flow fan blades formed at regular intervals in the circumferential direction of the hub and blowing cooling air in a suction direction along the axial direction; and a turbo blade formed extended at an outer end portion of the axial flow blade and blowing cooling air sucked in the axial direction by the axial flow blades, in a radial direction.

In the cooling air blowing apparatus of a refrigerator of the present invention, the axial flow blades are formed by 6~7 in number which are formed at regular intervals at an outer side of the hub.

In the cooling air blowing apparatus of a refrigerator of the present invention, the axial flow blade is formed as an axial flow fan type and formed in a curved face form having a certain radius of curvature and blows cooling air in the same direction as that of the cooling air sucked into the blowing fan.

In the cooling air blowing apparatus of a refrigerator of the present invention, the turbo blade is formed between blade tip and trailing edge of axial flow blade.

In the cooling air blowing apparatus of a refrigerator of the present invention, the turbo blade is formed extended along the curvature of the axial blade to form the same face with the axial flow blade.

In the cooling air blowing apparatus of a refrigerator of the present invention, the turbo blade is formed as a centrifugal turbo fan type and discharges cooling air in a suction direction along a radial direction to the blowing fan.

To achieve the above objects, there is further provided a cooing air blowing apparatus of a refrigerator including: a driving motor fixed at a motor mount formed at a rear side of a freezing chamber; a blowing fan mounted at a rotational shaft of the driving motor and blowing cooling air in a suction direction along the axial direction and blowing cooling air in a suction direction along a radial direction, while being rotated as the driving motor is driven; a shroud positioned in a circumferential direction of the blowing fan; and a guide unit formed at a front side of the shroud, guiding cooling air blown by axial flow blades to the freezing chamber and guiding cooling air blown by a turbo blade to a cooling chamber.

In the cooling air blowing apparatus of a refrigerator of the present invention, the guide unit includes: a guide plate extended as long as a certain width to a front side of the shroud and formed at a front side of the blowing fan; a guide hole formed at a front side of a guide plate and guiding cooling air blown by an axial flow blade to supply cooling air to freezing chamber; and a guide channel formed at a side of the guide plate and guiding cooling air blown by a turbo blade to supply cooling air to cooling chamber.

In the cooling air blowing apparatus of a refrigerator of the present invention, the guide hole has a diameter which is the same or larger than an outer diameter of the axial flow blade.

In the cooling air blowing apparatus of a refrigerator of the present invention, the guide channel is formed having the same width or larger than the width of the turbo blade.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of a cooling air blowing apparatus of a refrigerator in accordance with the present invention, of which a preferred embodiment will now be described.

Figure 1:
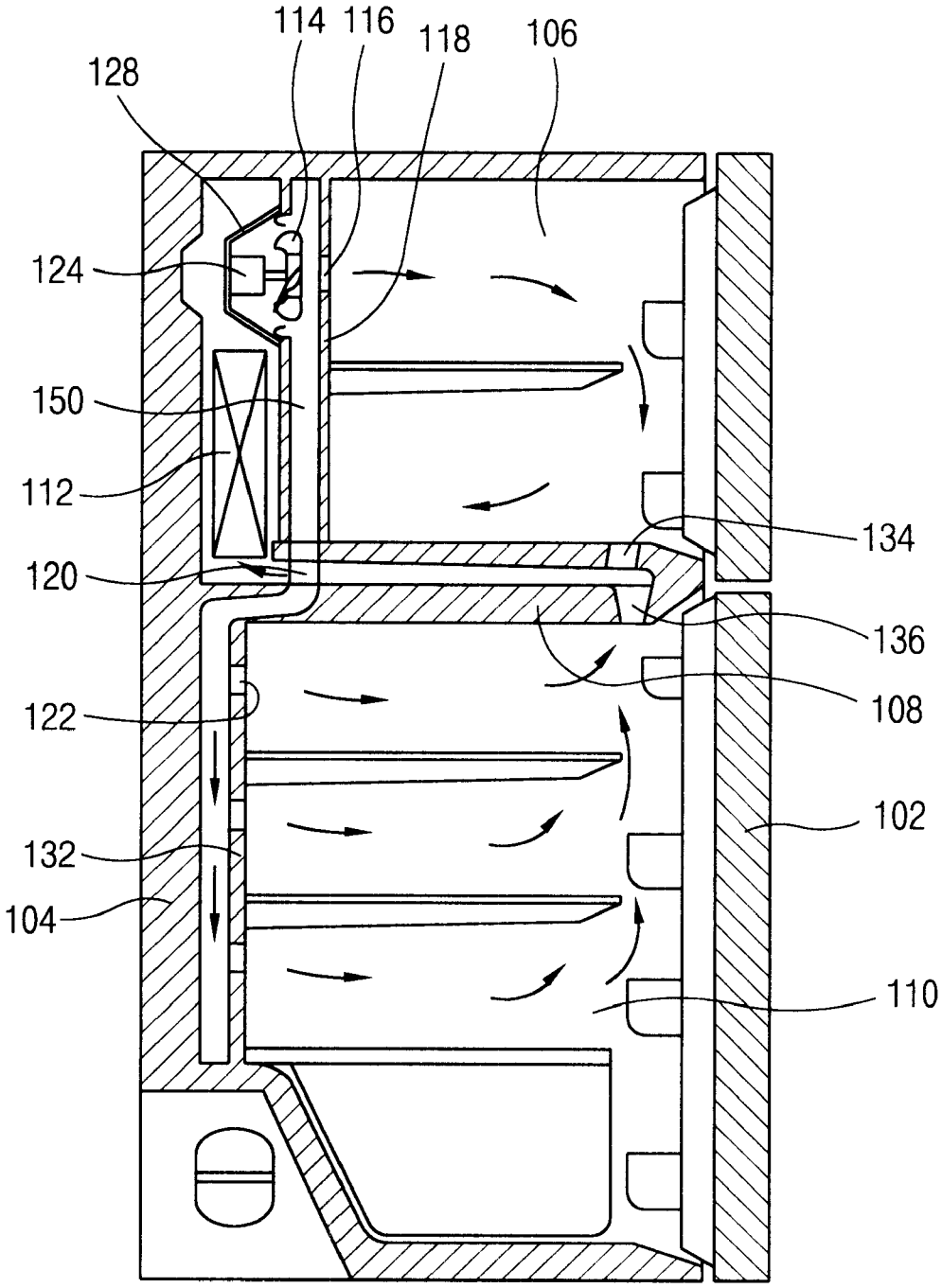
FIG. 1 CONVENTIONAL ART
FIG. 1 is a sectional view of a refrigerator in accordance with a conventional art.
Figure 2:
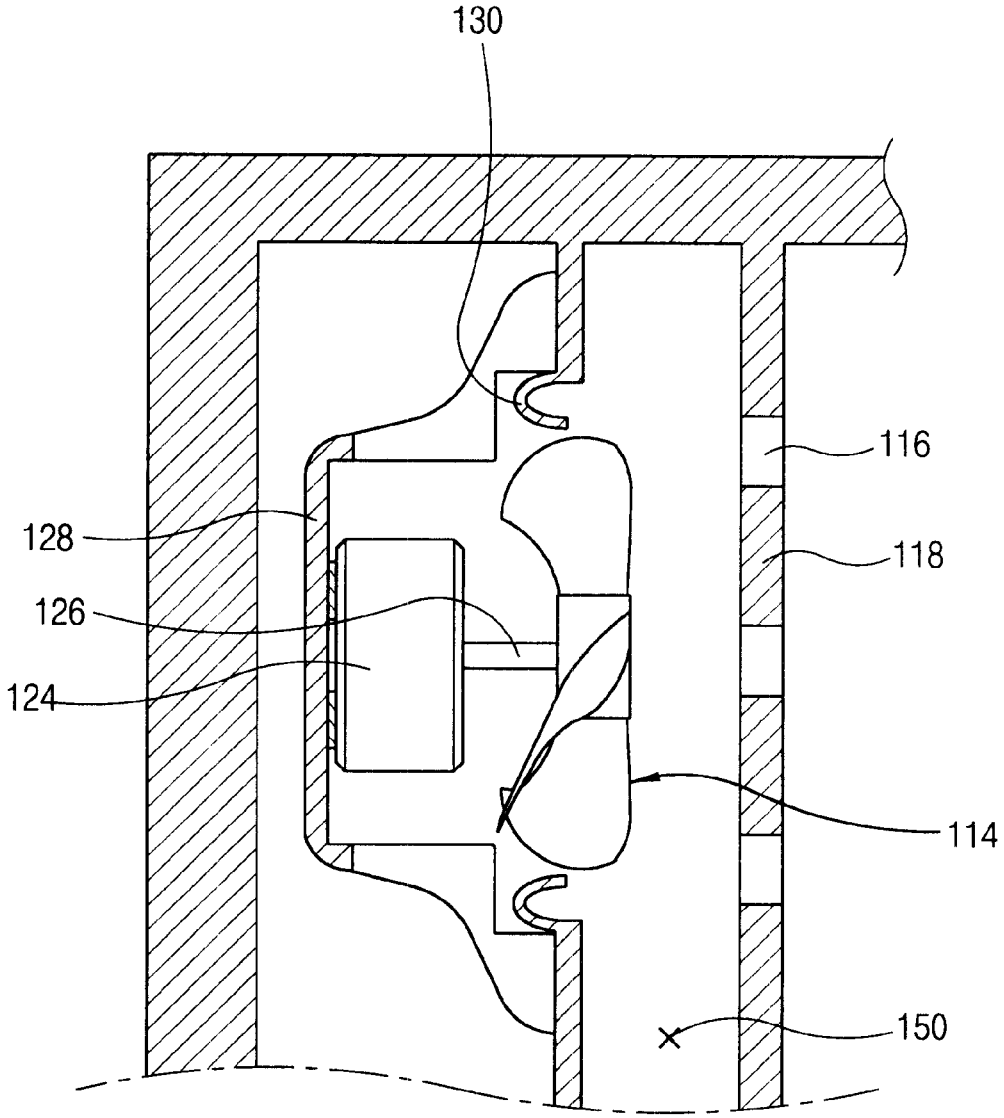
FIG.2 CONVENTIONAL ART
FIG. 2 is a partial sectional view showing a cooling air blowing apparatus of a refrigerator in accordance with the conventional art.
Figure 3:
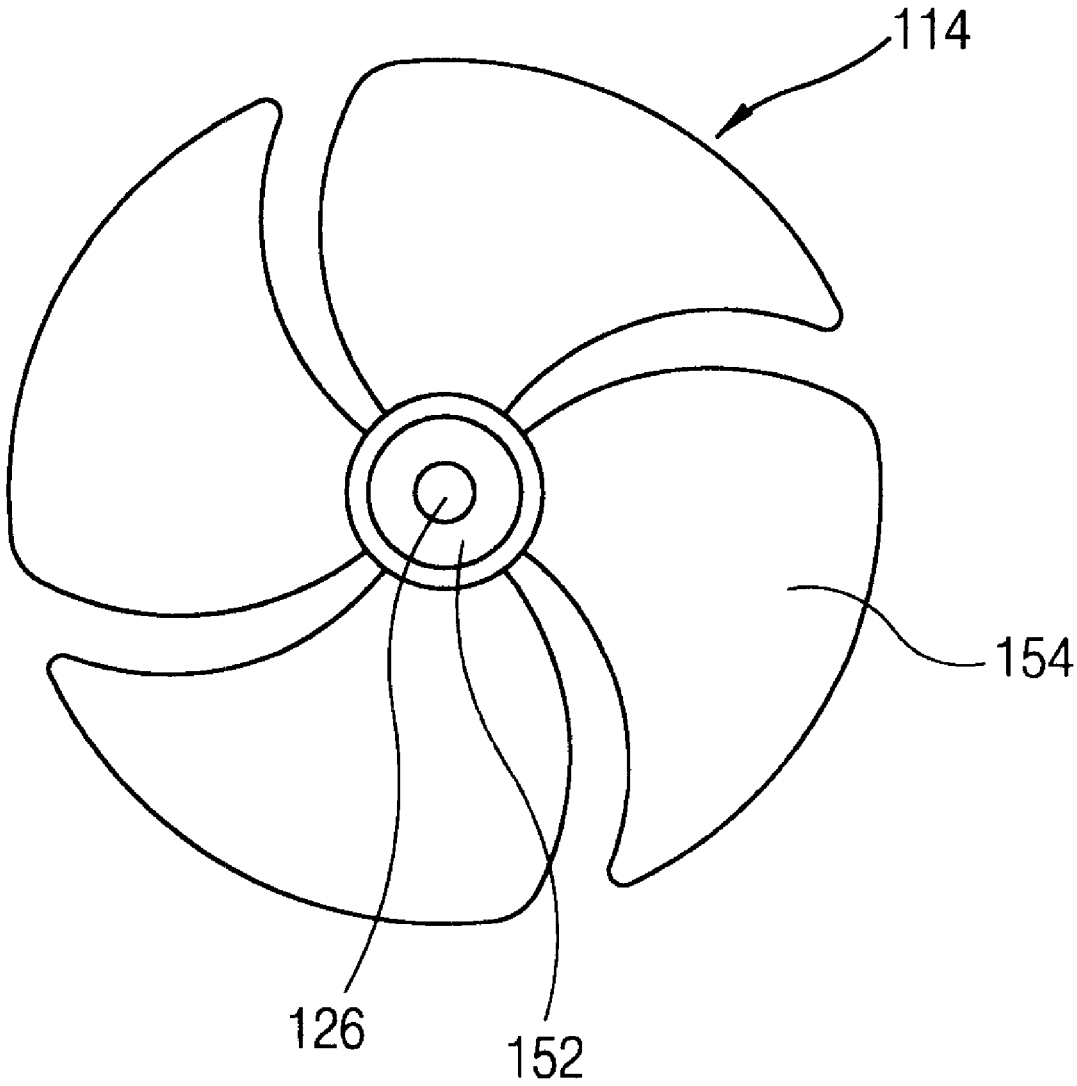
FIG. 3 CONVENTIONAL ART
FIG. 3 is a front view of an axial fan of the refrigerator in accordance with the conventional art.
Figure 4:
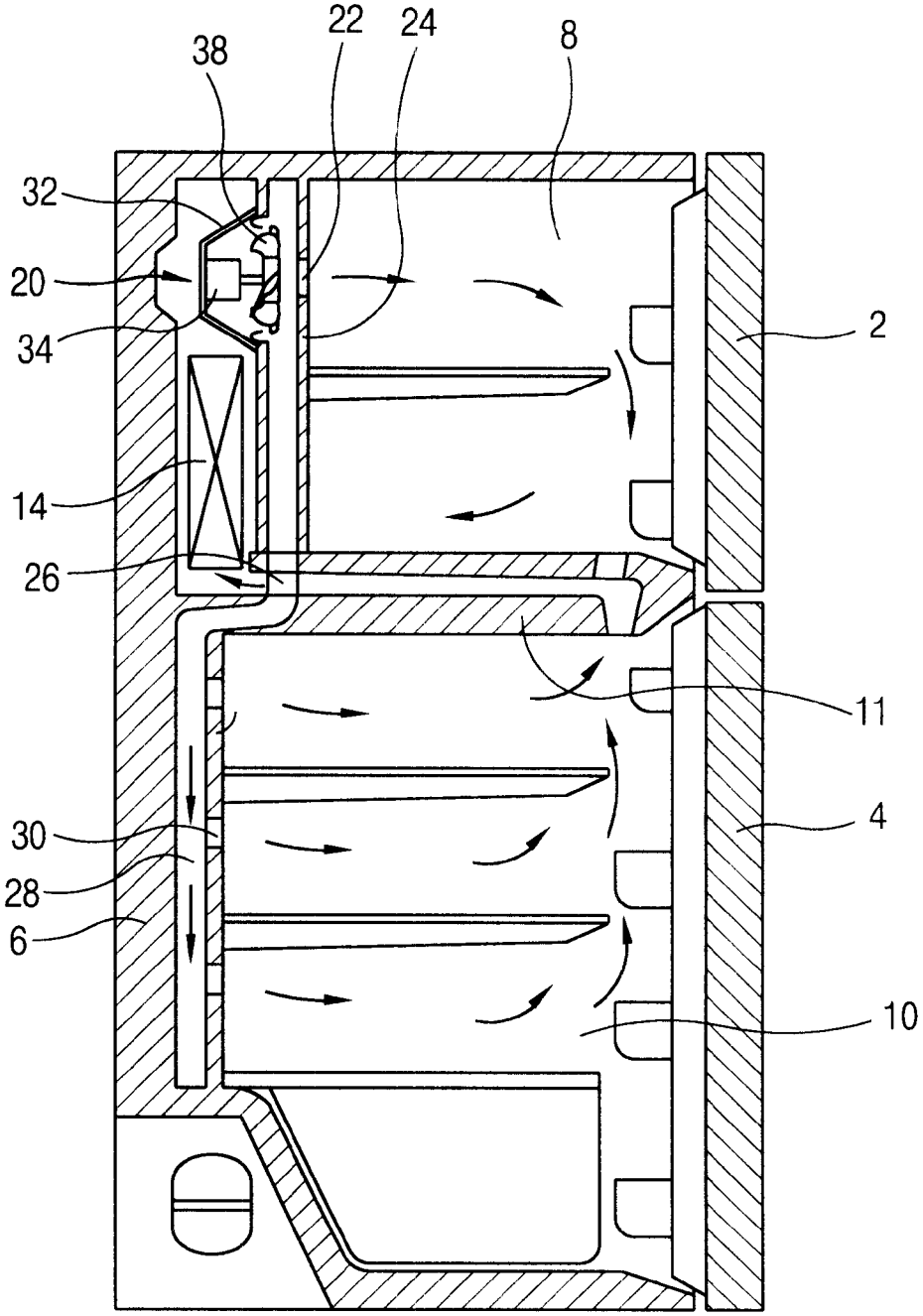
FIG. 4 is a sectional view of a refrigerator in accordance with one embodiment of the present invention.
Figure 5:
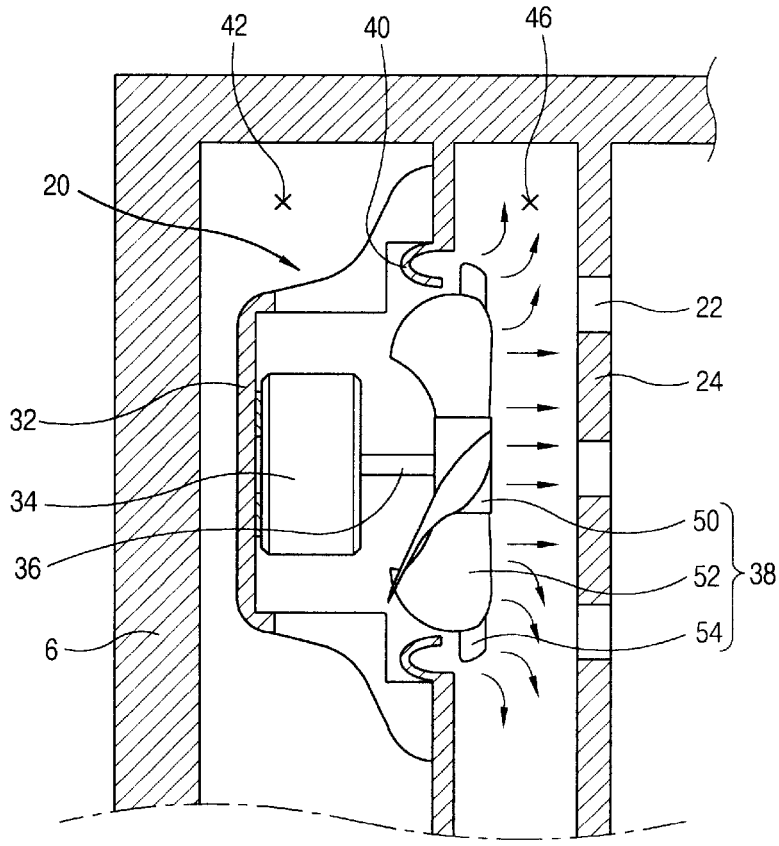
FIG. 5 is a partial sectional view showing a cooling air blowing apparatus of a refrigerator in accordance with one embodiment of the present invention.

FIG. 4 is a sectional view of a refrigerator in accordance with one embodiment of the present invention, and FIG. 5 is a partial sectional view showing a cooling air blowing apparatus of a refrigerator in accordance with one embodiment of the present invention.

A refrigerator of the present invention includes: a main body 6 provided with a freezing chamber door 2 and a cooling chamber door 4 installed to be opened or closed at a front side which is opened and has a certain space for storing foodstuffs; a freezing chamber 8 formed at an upper side of the main body 6 and keeping a frozen food; a cooling chamber 10 separated from the freezing chamber 8 by a barrier 11, formed at a lower portion of the main body 6 and keeping a refrigerated food; a heat exchanger 14 mounted at a rear side of the freezing chamber 8 and providing cooling air through heat exchange with a refrigerant; and a cooling air blowing unit for supplying cooling air generated while passing the heat exchanger 14 to the freezing chamber 8 and the cooling chamber 10.

The cooling air blowing unit includes: a cooling air blowing apparatus 20 attached at a rear wall face of the freezing chamber 8 and forcefully circulating air which has been cooled while passing the heat exchanger 14; a grill fan 24 having a plurality of discharge hole 22 for discharging cooling air blown by the cooling air blowing unit 20 to the freezing chamber 8; a supply passage 26 formed at the barrier 11 and supplying cooling air blown by the cooling air blowing apparatus 20 to the cooling chamber 10; and a cooling air duct 28 connected to the supply passage 26, having a plurality of discharge holes 30 for discharging cooling air to the cooling chamber 10, and being formed at least one of at the rear side or side face of the cooling chamber 10.

As shown in FIG. 5, the cooling air blowing apparatus 20 includes a driving motor 34 fixed at a motor mount 32 formed at a rear side of the grill fan 24, a blowing fan 38 mounted at a rotational shaft 36 of the driving motor 34 and blowing cooling air while being rotated as the driving motor 34 is driven; and a shroud 40 integrally formed at the motor mount 32 and positioned in a circumferential direction of the blowing fan 38.

The suction passage 42 for sucking cooling air which has passed the heat exchanger 14 is formed at the motor mount 32, and a branch passage 46 is prepared between the shroud 40 and the grill fan 24 to distribute cooling air blown by the blowing fan 38 to the cooling chamber 8 and the freezing chamber 10.

Figure 6:
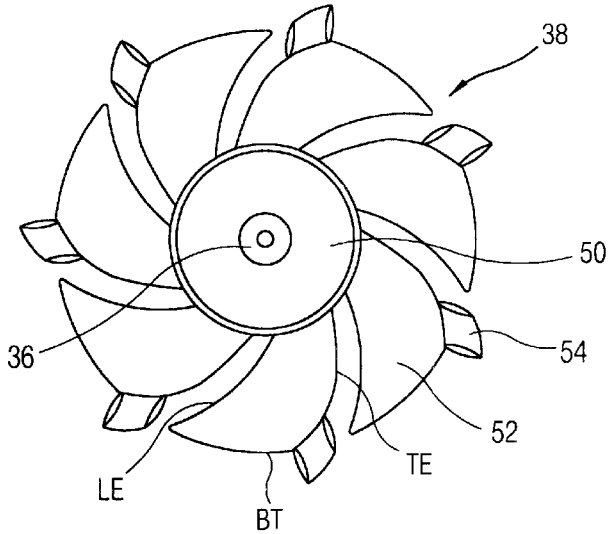
FIG. 6 is a front view of a blowing fan of the refrigerator in accordance with one embodiment of the present invention.

FIG. 6 is a front view of a blowing fan of the refrigerator in accordance with one embodiment of the present invention.

As shown in FIG. 6, the blowing fan of the present invention includes: a hub 50 fixed at a rotational shaft 36 of the driving motor 34; axial flow blades 52 formed at regular intervals in the circumferential direction of the hub 50 and blowing cooling air in a suction direction along the axial direction; and a turbo blade 54 formed at an outer end portion of the axial flow blade 52 and changing the flow of cooling air introduced in the axial direction to a radial direction and blowing the cooling air in the radial direction.

The axial flow blade 52 includes a blade tip (BT), that is, the face forming the outermost side; a trailing edge (TE), that is, the side face formed as a curve having a certain radius of curvature to the front side, and a leading edge (LE) formed as a curved face having a certain radius of curvature to a rear side.

The axial flow blades 52 blow cooling air in a suction direction along the axial direction. The axial flow blades 52 are formed as an axial flow fan and, preferably, three or seven axial flow blades are formed.

The turbo blade 54 is extended in a certain curve form at between the blade tip (BT) and trailing edge (TE) of the axial flow blade 52. The turbo blade 54 is connected in a smooth form without a joint along a curvature of the axial flow blade.

The turbo blade 54 blows cooling air in a suction direction along the radial direction, and is preferably formed in a same form as that of the blade of a typical centrifugal turbo fan.

When installed at the shroud 40, the blowing fan 38 is positioned with the shroud 40, on the basis of the width of the axial flow blade 52, such that the axial flow blade 52 is placed inwardly from the motor housing 32 and the turbo blade 54 is placed outwardly from the shroud 40, so that when the blowing fan 38 is rotated, it can be prevented from being interfered by the shroud 40.

With such construction, the blowing fan 38 can have both an effect generated from axial flow fan according to the rotation of the axial flow blade 52 and an effect generated from the centrifugal turbo fan according to the turbo blade 54.

The operation of the cooling air blowing apparatus constructed as described above in accordance with the present invention will now be explained.

First, when a power is applied to the refrigerator, the heat exchanger 14 is operated and the blowing fan 38 is driven. Then, cooling air passing the heat exchanger 14 is supplied to both the freezing chamber 8 and the cooling chamber 10 as the blowing fan 38 is driven.

That is, cooling air is blown in an axial direction of the direction in which cooling air is blown according to the rotation of the axial flow blade 52, and introduced into the branch passage 46.

A portion of the cooling air introduced into the branch passage 46 is discharged to the freezing chamber 8 through the discharge hole 22 formed at the grill fan 24, performing a freezing operation of the freezing chamber 8, while flowing of a portion of the cooing air blown is changed in the radial direction according to rotation of the turbo blade 54.

That is, a portion of the cooling air introduced into the branch passage 46 is blown in the radial direction of the direction in which cooling air is blown according to the rotation of the turbo blade 54 and supplied to the supply passage 26 through a lower side of the branch passage 46, and the cooling air supplied to the supply passage 26 is discharged to the cooling chamber 10 through the plurality of discharge holes 30 formed at the cooling air duct 28 of the cooling chamber 10, performing a cooling operation of the cooling chamber 10.

Figure 7:
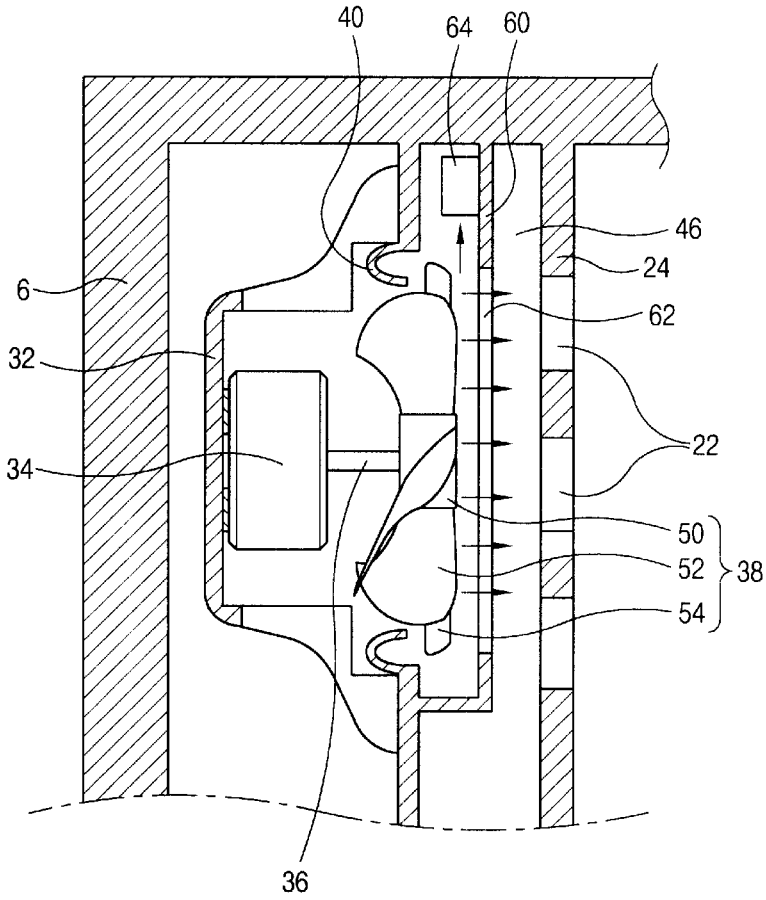
FIG. 7 is a partial sectional view showing a cooling air blowing apparatus of a refrigerator in accordance with another embodiment of the present invention.

FIG. 7 is a partial sectional view showing a cooling air blowing apparatus of a refrigerator in accordance with another embodiment of the present invention.

A cooling air blowing apparatus in accordance with another embodiment of the present invention includes: a motor mount 32 formed at a rear side of the grill fan 24, a driving motor 34 fixed at the motor mount 32, a hub 50 fixed at a rotational shaft 36 of the driving motor; a plurality of axial flow blades formed in an outer circumferential direction of the hub 50, a blowing fan 38 having a turbo blade 54 extended from an outer tip portion of the axial blade 52; a shroud 40 integrally formed with the motor mount 32 and formed in a circumferential direction of the blowing fan 38; and a guide unit formed at a front side of the shroud 40, guiding cooling air blown by the axial blades 52 to a freezing chamber and guiding cooling air generated by the turbo blade 54 to a cooling chamber.

The guide unit includes a guide plate 60 extended a certain width to the front side of the shroud 40 and formed on the branch passage 46 of the front side of the blowing fan 38; a guide hole 62 formed at a front side of the guide plate 60 and guiding cooling air blown by the axial flow blades 52; and a guide channel 64 formed at a rear face of the guide plate 60 and guiding cooling air blown by the turbo blade 54.

It is preferred that a diameter of the guide hole 62 is the same as or larger than an outer diameter of the axial flow blade 52 and a width of the guide channel 64 is the same as or larger than the width of the turbo blade 54.

In the cooling air blowing apparatus in accordance with the second embodiment of the present invention, when the blowing fan 38 is rotated according to driving of the driving motor 34, cooling air blown in a suction direction along the axial direction by the axial blade 52 passes the guide hole 62 and discharged into the freezing chamber 8 through the discharge hole 22 of the grill fan 24, performing a freezing operation.

Meanwhile, the cooling air blowing in a suction direction along the radial direction by the turbo blade 54 passes the guide channel 64 and is guided to the supply passage. The cooling introduced into the supply passage 26 is discharged into the cooling chamber 10 through the discharge hole 30 of the cooling air duct 28 formed in the cooling chamber 10, performing a cooling operation.

Figure 8:
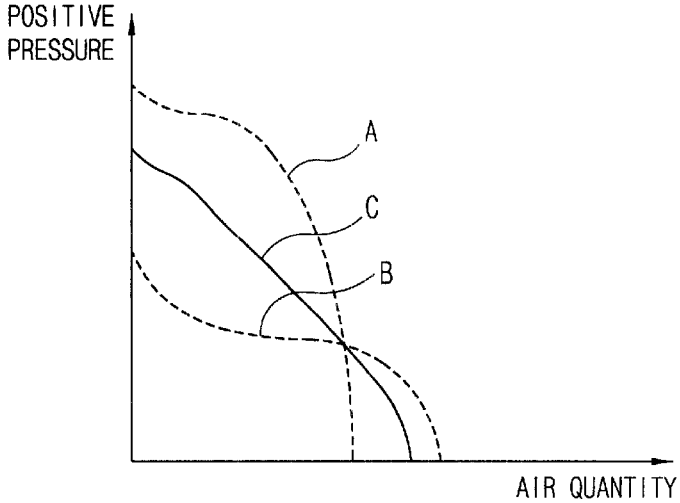
FIG. 8 is a graph showing a pressure and an air volume characteristic curve of the cooling air blowing apparatus of a refrigerator in accordance with the preferred embodiment of the present invention.

FIG. 8 is a graph showing a pressure and an air volume characteristic curve of the cooling air blowing apparatus of a refrigerator in accordance with the preferred embodiment of the present invention;

As shown in FIG. 8, the blowing fan 38 can obtain a pressure and air volume characteristic curve (C) which can accomplish a pressure and air volume characteristic curve of the axial flow fan according to the axial flow blades 52 and a pressure and air volume characteristic curve of a turbo fan according to the turbo blade 54.

Accordingly, as shown in the characteristic curve, both the characteristic of the axial flow fan and that of the turbo fan can be obtained.

Figure 9:
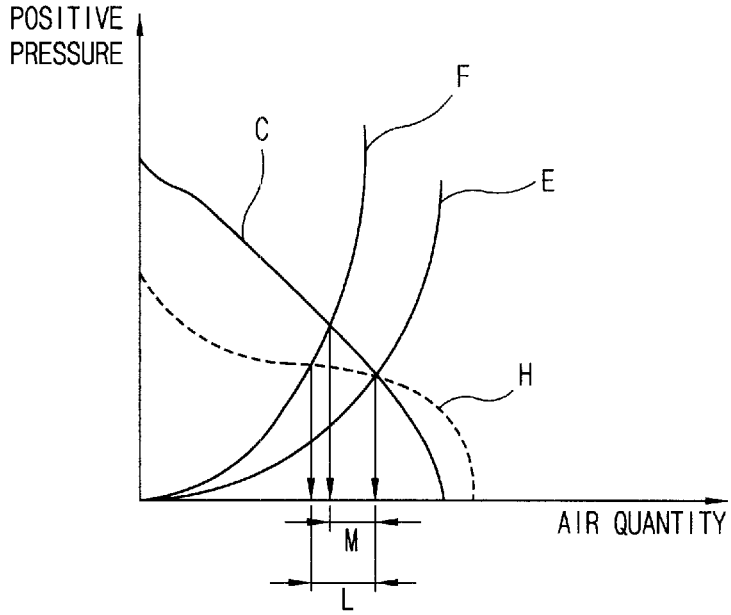
FIG. 9 is a graph showing air volume variations according to a flow resistance change of the ventilating fan of the present invention and of an axial flow fan of the conventional art.

FIG. 9 is a graph showing air volume variations according to a flow resistance change of the ventilating fan of the present invention and of an axial flow fan of the conventional art.

As shown in FIG. 9, in case that a cooling air flow resistance is changed from a curve (E) to a curve (F), the conventional axial flow fan (H) exhibits an air volume reduced as much as 'L', while the blowing fan (C) of the present invention exhibits an air volume reduced as much as 'M', so that, notably, the blowing fan of the present invention has the smaller width of air volume reduction compared with that of the axial flow fan of the conventional art.

Figure 10:
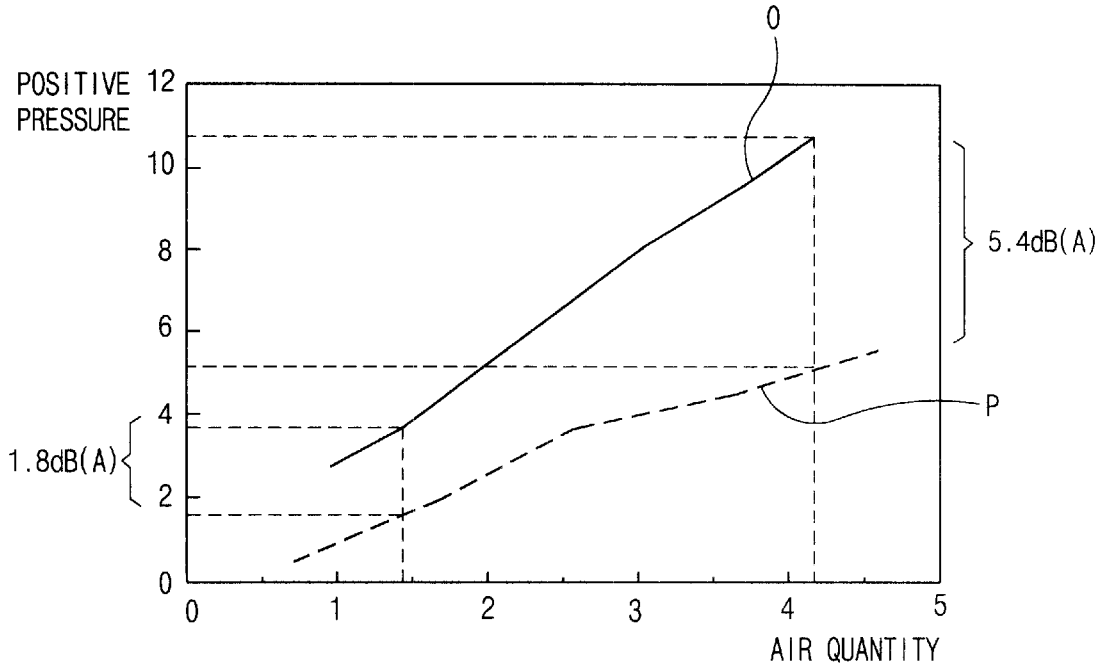
FIG. 10 is a graph showing a noise amount according to blowing of the blowing fan of the present invention and of the axial flow fan of the conventional art.

FIG. 10 is a graph showing a noise amount according to blowing of the blowing fan of the present invention and of the axial flow fan of the conventional art.

As shown in FIG. 10, with a basic air volume, a noise generated from the conventional axial flow fan (O) of the conventional art is approximately 3.6 dB, while a noise generated from the blowing fan (P) of the present invention is approximately 1.8 dB. Thus, the noise of the blowing fan (P) of the present invention is reduced as much as about 1.8 dB from the noise of the axial flow fan (O) of the conventional art.

Meanwhile, in case that air volume is raised by 40%, a noise of the axial flow fan (O) of the conventional art is approximately 10.6 dB while a noise of the blowing fan (P) of the present invention is approximately 5.2 dB. Thus, it is noted that the blowing fan of the present invention can reduce the noise by about 5.4 dB from that of the axial flow fan of the conventional art.

As so far described, the air cooling blowing apparatus of the present invention has many advantages.

That is, for example, the blowing fan for blowing cooling air into the cooling chamber and the freezing chamber includes a turbo blade for blowing cooling air in a radial direction of the direction in which cooling air is blown in addition to the axial flow blade for blowing cooling air in an axial direction of the direction in which cooling air is blown, to supply cooling air into the freezing chamber and the cooling air chamber. Thus, in the complicated and long cooling air passage structure, cooling air can be circulated smoothly and quickly.

In addition, since the axial flow fan type and the turbo fan type of the blowing fan are integrally formed to exert the characteristic of the axial flow fan and the characteristic of the turbo fan, the air volume can be increased while a noise is reduced. Accordingly, performance of the refrigerator can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A cooling air blowing apparatus of a refrigerator, comprising:

a driving motor fixed to a motor mount formed at a rear side of a freezing chamber;

a blowing fan mounted on a rotational shaft of the driving motor and configured to blow cooling air in an axial direction and in a radial direction, while being rotated as the driving motor is driven; and a shroud positioned in a circumferential direction of the blowing fan to minimize recirculation of cooling air into a suction chamber, wherein the blowing fan comprises:

a hub fixed on the rotational shaft of the driving motor, axial flow blades formed with a curved face having a certain radius of curvature formed at regular intervals along a circumference of the hub and configured to blow cooling air in an axial direction, and turbo blades that extend between a blade tip and a trailing edge along the curvature of the axial flow blade, extending beyond an outer diameter of the axial flow blades and configured to blow the cooling air in a radial direction.

2. The apparatus of claim 1, wherein the axial flow blades comprise 3–7 blades formed at regular intervals on an outer side of the hub.

3. The apparatus of claim 1, wherein the axial flow blades blow cooling air in the same direction as that of the cooling air sucked into the blowing fan.

4. The apparatus of claim 1, wherein the turbo blades are formed as centrifugal turbo fan type blades and are configured to discharge cooling air in a radial direction of the blowing fan.

5. The apparatus of claim 1, wherein each blade is connected in a smooth form without a joint along a curvature of a corresponding axial flow blade.

6. A refrigerator comprising the cooling air blowing apparatus of claim 1.

7. A cooling air blowing apparatus of a refrigerator, comprising:

a driving motor fixed to a motor mount formed at a rear side of a freezing chamber;

a blowing fan mounted on a rotational shaft of the driving motor and configured to blow cooling air in an axial direction and to blow cooling air in a radial direction, while being rotated as the driving motor is driven;

a shroud positioned in a circumferential direction with respect to the blowing fan to minimize recirculation of cooling air into the suction chamber; and a guide unit formed at a front side of the shroud, and configured to guide cooling air blown by one or more axial flow blades of the blowing fan to the freezing chamber and to guide cooling air blown by one or more turbo blades of the blowing fan to a cooling chamber.

8. The apparatus of claim 7, wherein the guide unit comprises:

a guide plate extended as long as a width of a front side of the shroud and formed at a front side of the blowing fan;

a guide hole formed on a front side of a guide plate and configured to guide cooling air blown by the axial flow blades of the blowing fan; and a guide channel formed at a rear side of the guide plate and configured to guide cooling air blown by turbo blades of the blowing fan.

9. The apparatus of claim 8, wherein the guide hole has a diameter which is the same or larger than an outer diameter of the axial flow blades.

10. The apparatus of claim 8, wherein the guide channel is formed having the same width or larger than the width of the turbo blades.

11. The apparatus of claim 7, wherein each turbo blade is formed extended between a blade tip and a trailing edge along the curvature of a corresponding axial flow blade.

12. The apparatus of claim 7, wherein the turbo blades are formed extended beyond a diameter of the axial blades of the blowing fan.

13. The apparatus of claim 7, wherein each turbo blade is connected in a smooth form without a joint along a curvature of a corresponding axial flow blade.

14. A refrigerator comprising the cooling air blowing apparatus of claim 7.

* * * * *